United States Patent [19]

Allred, III

[11] Patent Number: 4,545,338

[45] Date of Patent: Oct. 8, 1985

[54] CAM SHAFT TIMING CONTROL DEVICE

[75] Inventor: Neal C. Allred, III, Rte. 2, Box 68, High Point, N.C. 27260

[73] Assignees: Stephen E. Lawing; Neal C. Allred, III, both of High Point, N.C.

[21] Appl. No.: 677,100

[22] Filed: Dec. 3, 1984

[51] Int. Cl.[4] ..... F01L 1/34

[52] U.S. Cl. ..... 123/90.15; 123/90.18

[58] Field of Search ..... 123/90.15, 90.16, 90.17, 123/90.18

[56] References Cited

U.S. PATENT DOCUMENTS

| | | | |
|---|---|---|---|
| 2,060,580 | 11/1936 | Chapelle | 123/90.18 |
| 2,804,061 | 8/1957 | Gamble | 123/90.18 |
| 2,861,557 | 11/1958 | Stolte | 123/90.15 |
| 2,969,051 | 1/1961 | Webster | 123/90.18 |
| 3,144,009 | 8/1964 | Goodfellow et al. | 123/90.17 |
| 3,401,572 | 9/1968 | Bailey | 123/90.18 |
| 3,481,314 | 12/1969 | Crenn | 123/90.18 |
| 3,516,394 | 6/1970 | Nichols | 123/90.17 |
| 3,626,720 | 12/1971 | Meacham et al. | 123/90.15 |
| 3,685,499 | 8/1972 | Meacham et al. | 123/90.15 |
| 3,721,220 | 3/1973 | Garcea | 123/90.15 |
| 3,827,413 | 8/1974 | Meacham et al. | 123/90.15 |
| 3,945,355 | 3/1976 | Calviac | 123/90.18 |
| 3,978,829 | 9/1976 | Takahashi et al. | 123/90.17 |
| 4,091,776 | 5/1978 | Clemens et al. | 123/90.15 |
| 4,231,330 | 11/1980 | Garcea | 123/90.15 |
| 4,302,985 | 12/1981 | Natkin | 123/90.15 |
| 4,305,352 | 12/1981 | Oshima et al. | 123/90.15 |
| 4,401,069 | 8/1983 | Foley | 123/90.18 |
| 4,421,074 | 12/1983 | Garcea | 123/90.15 |

*Primary Examiner*—Ira S. Lazarus

*Attorney, Agent, or Firm*—Charles R. Rhodes; Judith E. Garmon

[57] ABSTRACT

An inner, generally circular plate secured to the end of an engine cam shaft is connected by means of a linking spider through a toggle linkage to an outer, annular plate driven directly by the engine crankshaft. The drag on the cam shaft during normal operation urges the inner plate toward a normal or "retard" position as no outward bias in the opposite direction is exerted on the spider. However, during selected phases of crankshaft operation, such as during low engine speeds, pressure sufficient to overcome the engine drag is brought to bear against a relatively large surface of the linking spider and biases the spider to an axially extended position. The axial movement of the toggle linkage then causes the inner plate to rotate relative to the outer plate to an "advance" position in which it remains so long as the outward bias remains on the spider. When the outward bias against the spider is eliminated, the engine drag draws the spider back to the normal or "retard" position.

8 Claims, 11 Drawing Figures

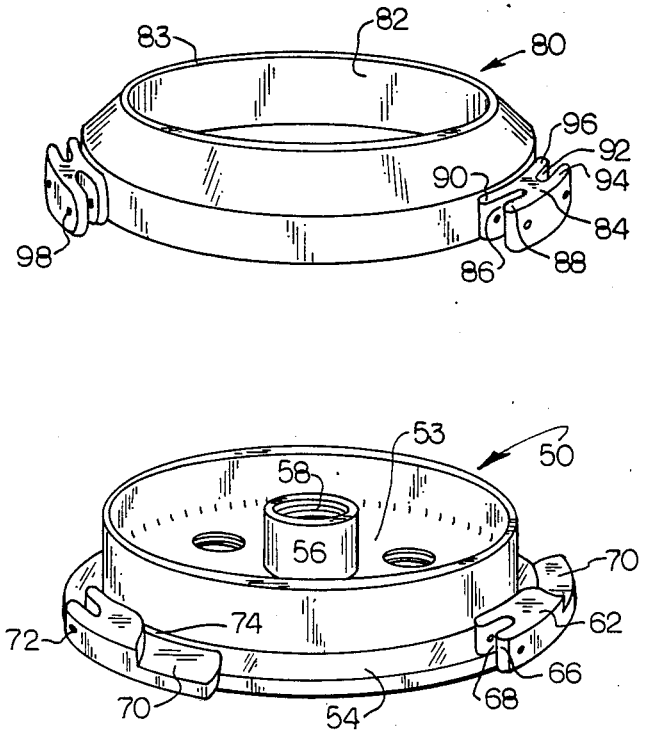
FIG. 4
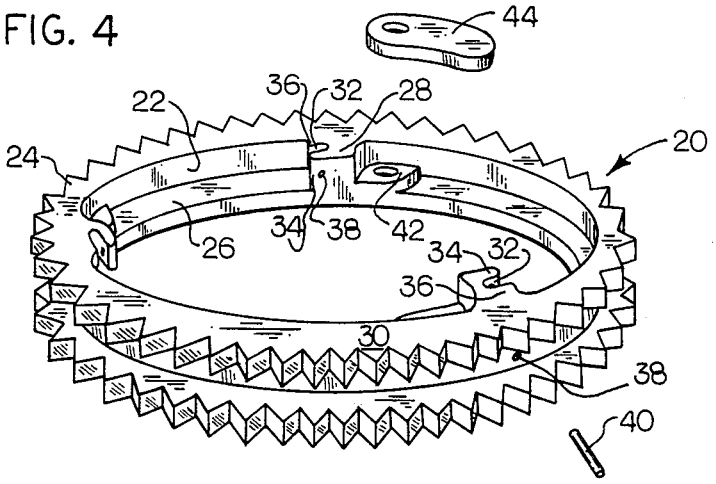

CAM SHAFT TIMING CONTROL DEVICE

BACKGROUND AND SUMMARY OF THE PRESENT INVENTION

The present invention relates to a hydraulic cam shaft advance and retard mechanism and more particularly to such a mechanism which advances and retards the cam shaft of an engine, such as an internal combustion or diesel engine, in response to speed of the engine or other prescribed characteristics. The invention is also applicable to other mechanisms in which one rotating member is to be rotated synchronously or at prescribed timing variations with respect to a second rotating member while torque is being continuously transmitted between the two members.

In a typical internal combustion or diesel engine, the mechanism which controls the introduction of the fuel-/air mixture into the cylinder and which controls the emission of exhaust gases from the cylinder is coupled to the engine crankshaft through a system of gears, chains, or belts and cams or equivalent means. Thus, in the absence of suitable adjustment means, the timing of the fuel/air mixture introduction into the cylinder and exhaust emission (determined by the cam shaft) with respect to piston position (which controls the crankshaft) is fixed by the design parameters of the engine. However, such engines operate much more efficiently if the timing of the cam shaft with respect to the crankshaft can be varied responsive to changes in engine speed or other operating characteristics. Thus, it is generally desirable to close the fuel intake valves earlier at low speeds to prevent the fuel and air mixture from being blown back through the intake valve. Conversely, at high speeds it is generally desirable to retard the operation of the fuel intake valve, because if the valve closes too quickly, the amount of fuel/air mixture delivered to the combustion chamber may be inadqeuate for maximum performance. Therefore, it is desirable to be able to vary the timing of the operation of the intake valves during the operating cycle. The intake valves are conventionally controlled by the engine cam shaft, which is in turn driven by the engine crankshaft. Thus, in order to vary the timing of the opening and closing of the intake valves, the relative rotational position of the cam shaft with respect to the drive or crankshaft must be capable of adjustment during the operation of the engine.

It is toward this general concept of cam shaft timing adjustment that the present invention is directed. This concept has been recognized before and has been approached in several ways. First of all, in U.S. Pat. Nos. 2,861,557 to Stolte and 4,091,776, to Clemens et al, there is illustrated and described a cam shaft timing control device in which the connecting member between the drive shaft and cam shaft includes a plurality of cooperating vanes. One set of vanes is connected to the drive member (crankshaft) and the other set of vanes is connected to the driven member (cam shaft). As ignition begins and rotation of the crankshaft commences, oil pressure is admitted to a chamber between adjacent vanes and a buildup of such pressure causes the vanes to separate, thereby creating a rotational adjustment of the cam shaft with respect to the drive shaft. Because of close tolerances which must be maintained and the volume of oil which must be circulated to operate the vanes, these devices are very expensive. Further, the size of these devices is such that they cannot fit existing domestic automotibles without significant alteration thereto.

In another approach illustrated and described in U.S. Pat. No. 3,721,220 to Garcea, the connecting member between the cam shaft and the drive shaft includes a plurality of arcuately shaped, intermeshed members which are initially separated a prescribed distance by a hydraulically operated ball stop. As engine speed increases, the amount of fluid delivered to the hydraulic ball stops is varied, thereby causing a displacement of one set of arcuate members with respect to the other. This displacement translates into a change in the rotational relationship between the cam shaft and drive shaft, thereby creating advance or retard timing. This device is believed to be designed to operate with separate cams for intake and exhaust valves and would not operate on single cam designs of more than four cylinders, because of the hydraulic pressure which would be necessary to operate pistons 22. In another series of patents, namely U.S. Pat. Nos. 3,401,572 to Bailey; 4,302,985 to Natkin; and 4,421,074 to Garcea et al, the crankshaft and cam shaft are connected by a coupling which includes a piston moved axially by means of hydraulic pressure. The piston rides on a helical spline attached to one or other of the crankshaft or drive shaft. Thus, the axial movement of the piston causes a relative rotations displacement between the drive shaft and crankshaft.

Finally, another series of patents, namely U.S. Pat. Nos. 3,626,720 to Meacham et al; 3,685,499 to Meacham et al; and 3,827,413 to Meacham, each illustrate and describe a timing control device which is somewhat similar to the series of patents identified in the paragraph immediately hereinabove. The exception here is that a helical ball spline connects the driven member (cam shaft) with the driving member (crankshaft). The helical ball spline will thus reduce the frictional drag which might be attendant to the use of merely a helical spline.

While each of the approaches set forth above result in a cam shaft timing control, they have achieved varying degrees of success, and are in general relatively complicated and expensive to effect. For example, many of the devices utilize a heavy spring to normally bias the cam shaft in one direction or the other. When the hydraulic pressure (bias) is then removed, the heavy spring may or may not perform as designed to overcome the frictional drag on the engine and return the cam shaft to the normal or home position. Also, most, if not all of the prior art discussed hereinabove require a major modification to the cam shaft in order to effect the control coupling which must be mounted between the cam shaft and the crankshaft.

In the present invention, however, a different approach is used which is designed to eliminate the problems and complicated mechanisms described hereinabove. The present invention is designed to maximize the force applied to the system while at the same time minimizing the size (particularly in the axial direction) of the control device so that it may be incorporated into existing automobile engine housings. Toward this end, in general, the timing control of the present invention utilizes the load and drag of the cam shaft to normally maintain the control mechanism in the home or retarded position. Upon engine ignition, or upon the attainment of other prescribed parameters, the oil pressure of the lubricating system is utilized to advance a unique toggle linkage between the cam shaft and crankshaft to an "advance" position in which the cam shaft is rotated slightly relative to the crankshaft. Neither the crankshaft nor the cam shaft require significant modification thereto, as the control device is merely mounted to the end of the cam shaft and connected to the crankshaft by a chain, belt or gear. Further, the device is relatively frictionless. In general, the timing device of the present invention is made a part of the sprocket which receives the driving force from the crankshaft. The timing device includes an inner plate secured to the end of the cam shaft and having at least one passageway therethrough in communication with lubrication system of the engine. An outer plate surrounds the periphery of the inner plate in rotatably adjustable relation thereto and, of course, is directly connected in synchronous driven relation to the crankshaft. The heart of the present invention resides in a linking spider which is mechanically connected between the inner plate and outer plate through a toggle linkage which transmits the driving force from the outer plate to the inner plate. In the retard position, the drag forces exerted on the cam shaft through the spider to the inner plate by means of the aforesaid connecting linkage provides a pull on the linkage tending to keep the inner plate in the normal or "retard" position. However, at low speeds, oil pressure is exerted axially against a relatively large surface in or on the connecting spider to move the spider axially from its normal position. This axial movement of the spider causes a displacement of the connecting toggle linkage, thereby arcuately altering the relationship between the cam shaft and the crankshaft to the "advance" position.

The hydraulic pressure which actuates the spider may be controlled by a centrifugal valve which is closed causing the pressure to build up during low speeds, then opens to bleed off the pressure during high speeds; or it may be controlled by a solenoid operated hydraulic valve to cause buildup of oil pressure or to bleed off oil pressure responsive to a computer or microprocessor which is continuously monitoring various engine characteristics such as vacuum, engine speed, or other characteristics, which characteristics may be compared to control the opening and closing of the hydraulic valve more closely.

It is therefore an object of the present invention to provide a cam shaft timing control of the type described which is simpler in design and more reliable than previously known devices.

It is another object of the present invention to provide a cam shaft timing control of the type described which utilizes the load and drag on the cam shaft to normally bias the control device to one position.

Other objects and a fuller understanding of the invention will become apparent from reading the following detailed description of a preferred embodiment along with the accompanying drawings in which:

FIG. 4 is an exploded perspective of the three major elements of the timing device of the present invention;

Figure 9A:
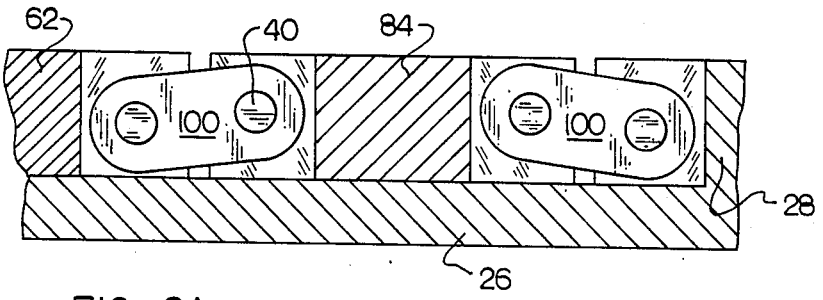
Figure 9B:
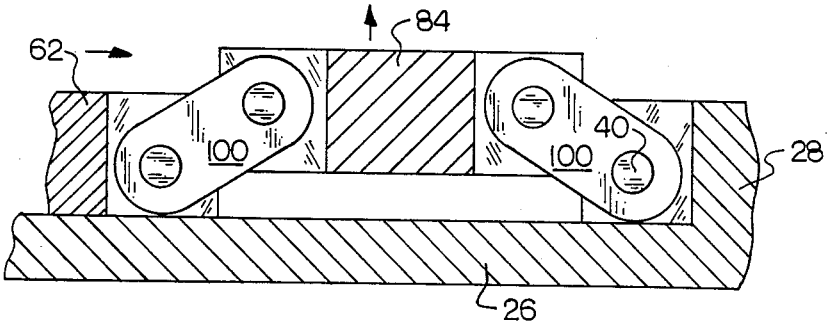
Figure 10:
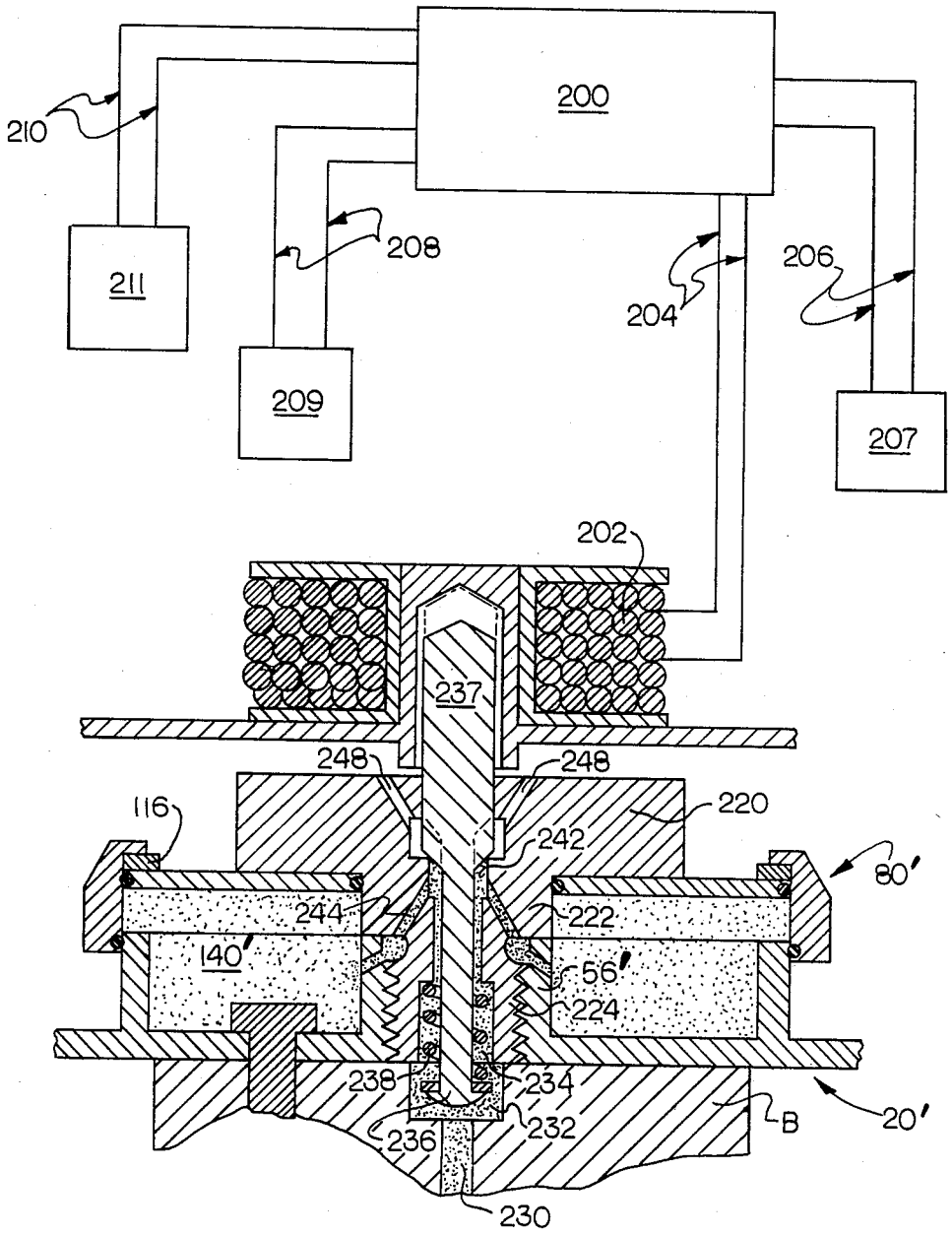

FIGS. 9*a* and 9*b* are partial sectional views illustrating the manner in which the linking spider causes the inner plate to rotate relative to the outer plate; and FIG. 10 is a partial sectional view illustrating an alternate embodiment which includes a solenoid operated hydraulic control valve.

DETAILED DESCRIPTION OF A PREFERRED EMBODIMENT

Figure 1:
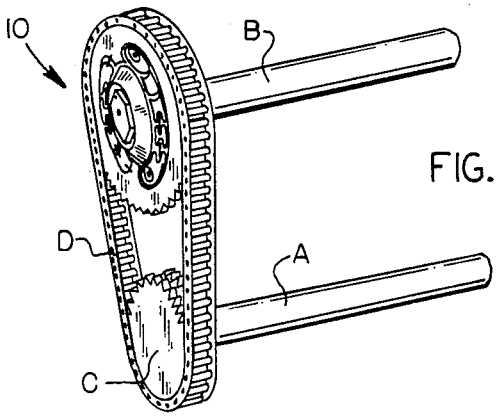
FIG. 1 is a schematic representation of a typical arrangement between a crankshaft and cam shaft with the timing device of the present invention installed on the cam shaft drive sprocket.

Referring now to the drawings, and more particularly to FIG. 1, the timing mechanism 10 according to the present invention is shown functionally attached to the cam shaft B of a vehicle multi-cylinder engine. The cam shaft B is driven in timed relation to the engine crankshaft A through the timing mechanism 10, the latter serving to control the operating relationship between the two shafts by varying the rotational position of the cam shaft with respect to the crankshaft as required by operating conditions. In order to effect the driving arrangement between cam shaft B and crankshaft A, crankshaft A includes a sprocket C thereon which is connected by a chain D to teeth on the periphery of timing device 10.

As illustrated in FIGS. 2–6, the timing device 10 is, in general, comprised of three major components: a sprocket plate or outer plate 20; a hub plate or inner plate 50; and a linking spider 80 (FIG. 4).

The outer plate or sprocket plate 20 comprises an annular cylindrical wall 22 having a plurality of radially outwardly extending teeth 24 to which chain D is connected in driven arrangement with crankshaft A through sprocket C. An inturned or annularly inward ledge 26 extends around the lower inner periphery of cylindrical wall 22 forming a trackway. At three peripherally spaced positions (approximately 120° apart) an inwardly extending lug 28 is provided in the aforesaid trackway. Lug 28 is of approximately the same radial dimension as the inturned flange 26 and extends upwardly from flange 26 to the top surface 30 of annular wall 22. A vertical slot 32 extends inwardly from one side of lug 28 toward the central region thereof forming on either side of said slot 32 a pair of side walls 34, 36. A hole 38 extends horizontally through walls 34 and 36, and on through wall 36 to communicate with the exterior of the sprocket plate 20 between the rows of teeth 24,24'. This opening 38 receives a connecting pin 40 for reasons to be hereinafter described.

Finally, a boss 42 is fixed to the annular ledge 26 immediately adjacent the side wall of lug 28 opposite the side in which slot 32 appears. This lug is for the purpose of mounting a securing member 44, the purpose of which will be described hereinafter.

Figure 7:
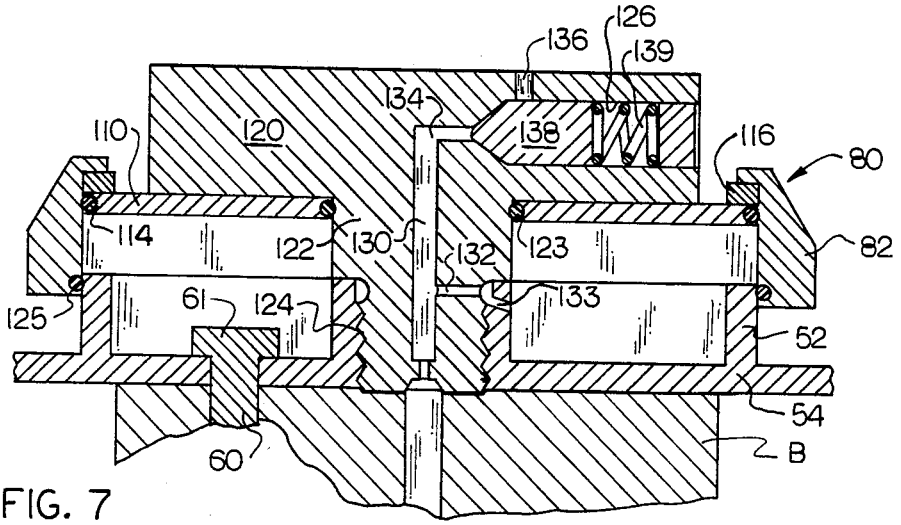
FIG. 7 is a partial schematic sectional view illustrating the timing device in the advance position by the introduction of oil under pressure.
Figure 8:
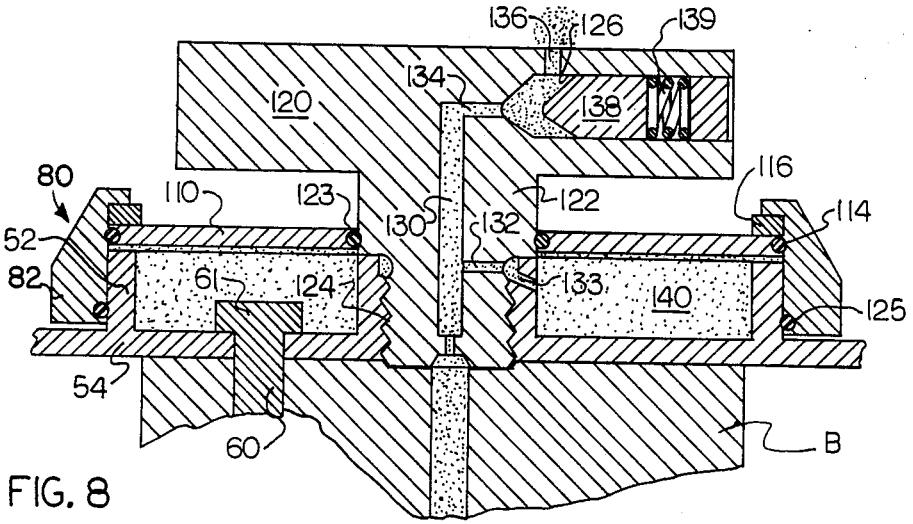
FIG. 8 is a partial schematic sectional view similar to FIG. 7, except showing the timing device with the oil pressure being bled off.

The hub or inner plate 50 is formed by an upstanding cylindrical wall 52 extending upwardly from a base 53, which is extended to form an out-turned flange 54 around the periphery of cylindrical wall 52. It should be noted here that the exterior periphery of flange 54 and the interior periphery of the inward flange 26 of the outer plate 20 are arranged in contiguous relation. Within the upstanding wall 52 and extending upwardly from base 53 is a central hub 56 having a threaded passageway 58 therethrough for receiving an assembly knob as illustrated and described with reference to FIGS. 5, 7 and 8. Further, the passageway 58 cooperates with a passageway in the cam shaft B to communicate with the lubrication system of the engine to provide a continuous flow of oil thereinto. A plurality of openings 60 in the base of inner plate 50 provide means for the plate 50 to be secured to the end of cam shaft B by means of nuts 61 (FIGS. 7 and 8).

A plurality of peripherally spaced lugs 62 are positioned about the annular flange 54 (approximately 120° apart). Looking at FIG. 4, it should be noted that the lugs 62 extend radially outwardly from flange 54 so that they actually extend into the aforesaid trackway in arcuate alignment with the aforementioned inward extending lugs 28 on sprocket 20. Again, in one end of lugs 62, there is provided a vertically extending slot 64 facing in the opposite direction from the aforementioned slots 32 in lugs 28. Slot 64 forms side walls 66 and 68. Extending peripherally from the opposite end of lugs 62 is a shelf or plate 70 spaced from flange 54 and overlying the aforementioned boss 42 on the sprocket or outer plate 20 when the inner plate 50 and outer plate 20 are assembled together. Opening 72 extends through the walls 66, 68 of lugs 62 to receive connecting pins 40 in the manner similar to that described hereinabove. Before moving on to a discussion of linking spider 80, it should be noted that a clearance space 74 is provided between the outer periphery of upstanding wall 52 and the inner periphery of lug 62 into which the wall 82 of linking spider 80 is received.

The linking spider 80 also includes an upstanding cylindrical wall 82 and a plurality of peripherally spaced ears 84 (approximately 120° apart), which ears form the linking member between the inwardly extending lugs 28 of outer plate 20 and the outwardly extending lugs 62 of the inner plate 50. Again, vertically extending slots 86 and 92 are formed in opposite sides of the ears 84 thereby forming side walls 88, 90 and 94, 96, respectively. When assembled, openings 98 form passageways for connecting pins 40 to connect the ears 84 with adjacent members by means of connecting links 100 as will be described hereinafter. The radial thickness of wall 82 is such that it is slidably received in the space 74 between the upstanding wall 52 and the lug 62 of the inner plate 50. (See FIGS. 2 and 3).

Figure 2:
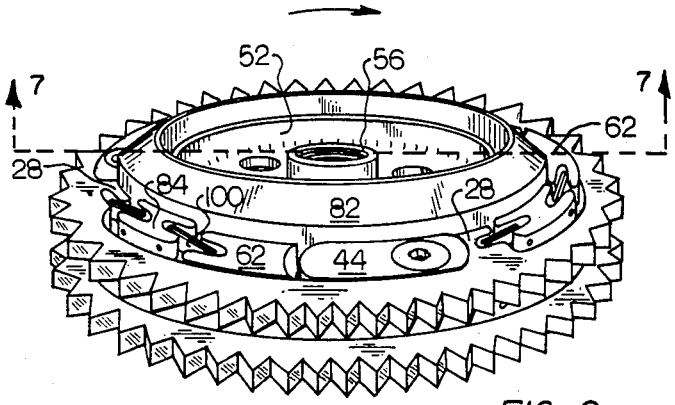
FIG. 2 is a perspective view of the timing device of the present invention with the cover plate removed therefrom, illustrating the timing device in the advanced position.
Figure 3:
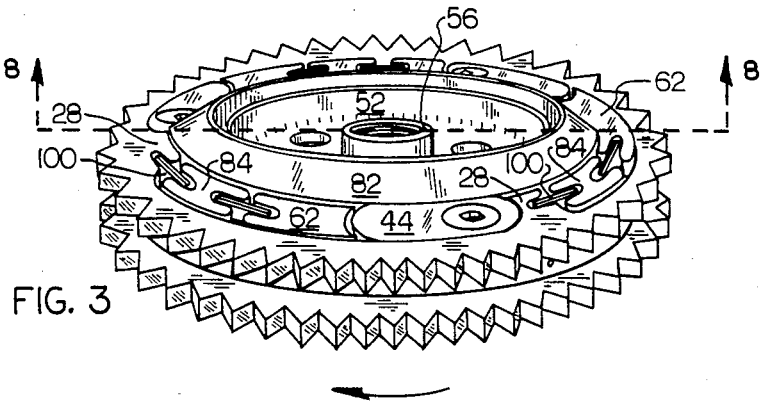
FIG. 3 is a perspective view similar to FIG. 2 except illustrating the timing device in the retard position.

Referring now to FIGS. 2 and 3, in the assembled position, an inwardly extending lug 28 of outer plate 20, a radially protruding ear 34 of the linking spider 80, and an outwardly extending lug 62 of the inner plate 50 are all assembled and connected successively by means of links 100. Therefore, there will be three such successive assemblies around the periphery of the inner and outer plates 50, 22. So arranged, as the outer plate 20 is caused to rotate in the clockwise direction in FIGS. 2 and 3, the cam shaft B is caused to be driven in synchronous timed relation to the crankshaft. This has been and will hereinafter be referred to as the "retard" position. During this time, the timing mechanism 10 is as illustrated in the configuration of FIG. 3.

Figure 5:
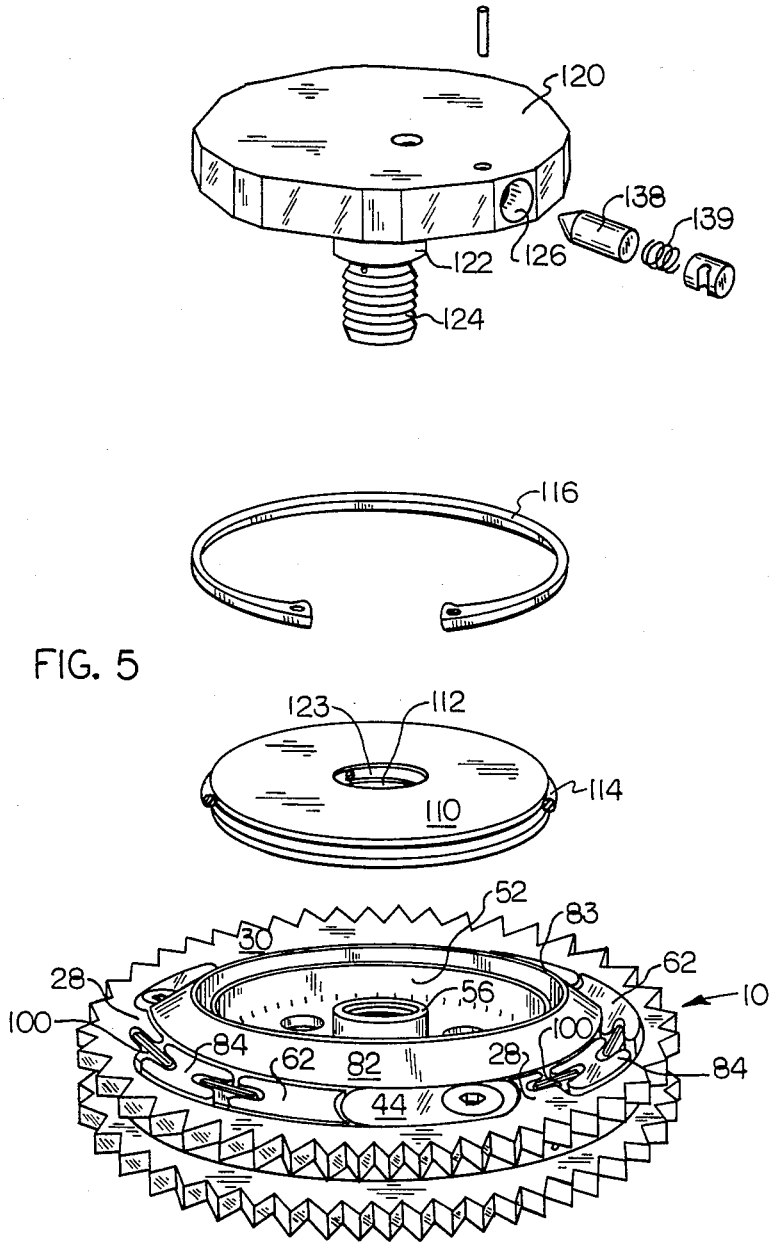
FIG. 5 is a perspective view similar to FIG. 3, except showing the cover plate and assembly knob in exploded relation thereto.
Figure 6:
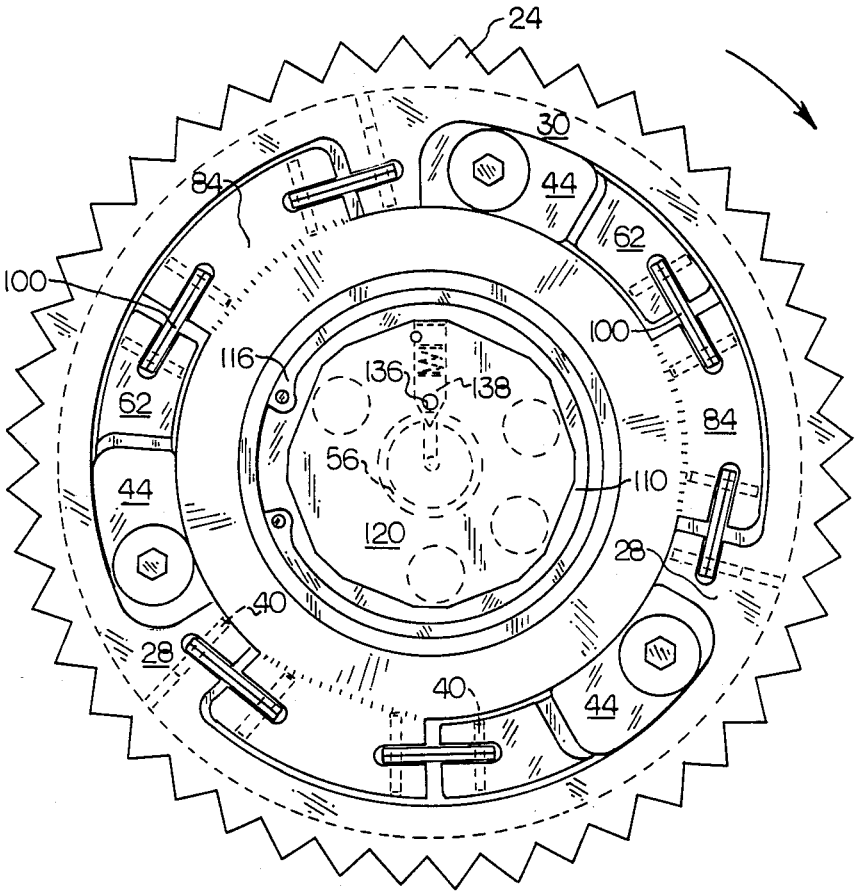
FIG. 6 is a plan view of the control device illustrated in FIGS. 2–5.

In FIG. 5, there is illustrated the manner in which the assembly is completed once the timing device 10 has been secured to cam shaft B. In this regard, a cover plate 110 having a central opening 112 therein is received across the opening formed by the upstanding wall 82 of linking spider 80. Looking again at FIG. 4, it is noted that the upstanding wall 82 includes a lip 83 on the upper edge thereof which extends inwardly from the periphery of wall 82. Cover 110 then fits downs inside the upstanding wall 82 and rests atop the upstanding wall 52 of the hub or inner plate 50. An O-ring 114 is fixed in a peripheral groove in cover plate 110, so that a sealing arrangement between the periphery of plate 110 and the upstanding wall 82 is achieved. A fastening spring 116 then is inserted down atop cover 110 and beneath the lip 83 of upstanding wall 82 and prevents removal of cover 110. Finally, an assembly knob having a hub 122 and threaded shaft 124 is inserted through opening 112 and is affixed into the threaded opening 58 in the central hub 56 of inner plate 50. Other O-rings 123 and 125 (FIGS. 7 and 8) seal the inner periphery of cover 110 to hub 122, and the wall 52 to the inner periphery of wall 82 so that oil cannot escape through these interfaces. Assembly knob 120 includes a radial opening 126 therein for the receipt of a centrifugal valve 138 in one embodiment, the operation of which will be described hereinafter.

Turning now to FIGS. 7 and 8, there is illustrated a sectional view taken from FIG. 2 which is illustrative of the manner in which the oil pressure is controlled to cause the aforementioned spider to move axially between the extended position (FIG. 7) and the retracted position (FIG. 8). An oil passageway 130 is in communication with the aforementioned oil reservoir of the engine. Passageway 130 extends axially along the length of threaded shaft 124 and hub 122 of control knob 120. A restrictor 131 at the entrance to passageway 130 controls the amount of oil which may be introduced thereinto. A first branch passageway 132,133 provides communication between the main passageway 130 and the chamber 140 formed beneath cover plate 110 and further defined by the base and side wall 52 of inner plate 50 and the inner periphery of the cylindrical wall 82 of spider 80. The main passageway 130 terminates in an angled passageway 134 leading to the radial opening 126 in control knob 120. An outlet passageway 136 is provided through the wall of control knob 120. The centrifugal valve 138, which operates in a conventional manner, is mounted within passage-way 126 to control the amount of fluid pressure within chamber 140.

The action is described in the following manner: as ignition occurs and the operation of the engine commences, the oil pressure builds up within chamber 140 and moves the spider 80 to its extended position (FIG. 7). At this time the centrifugal valve 138 is closed and the passage of fluid to outlet 136 is blocked. As engine speed increases to a prescribed rate, the centrifugal valve 138 moves upwardly as illustrated in FIG. 8 against spring 139 so that the oil is allowed to bleed off from passageway 130 through outlet passageway 136. This reduces the oil pressure within chamber 140, and thus removes the bias of the linking spider toward the extended position. The drag on the cam shaft by the engine components operating thereon will cause the links 100 connecting lugs 28, 62 and ears 84 to return to a linear position as illustrated in FIG. 3. The timing mechanism then is returned to the home or "retard" position illustrated in FIG. 8. It should be pointed out at this time that the entire timing device illustrated in FIGS. 7 and 8 is enclosed in a housing which receives and circulates the oil being emitted from opening 136 back to the oil reservoir.

While the hydraulic operation of the timing device 10 is illustrated and described with reference to FIGS. 7 and 8, the mechanical action is schematically represented in FIGS. 9*a* and 9*b*. In these figures it can be seen that as the ear 84 of linking spider is moved axially to the advanced position as illustrated in FIG. 9*b*, the lug 62 of the inner plate 50 is caused to rotate arcuately toward the lug 28 of the outer plate. This causes the relative rotation and adjustment of the timing as has been described hereinabove.

An alternative embodiment is illustrated in FIG. 10. In this embodiment, rather than the timing being controlled by a centrifugal valve responsive solely to engine speed the movement of the linking spider 80' is effected by a microprocessor 200 and solenoid 202 which are interconnected by a pair of control wires 204. The microprocessor 200 is connected to and continuously monitors such operating characteristics as vacuum, engine speed, and crankshaft and cam shaft position by means of: a cam shaft position sensor 207 connected to microprocessor 200 by means of control wires 206; crankshaft position and engine speed sensor 209 connected to microprocessor by control wires 208; and a vacuum sensor 211 connected to microprocessor by control wires 210. In this regard, the microprocessor continuously picks up the vacuum signal to sense the load on the motor and simultaneously is sensing engine speed. By comparing the relation of these two characteristics with a lookup table in the microprocessor, the timing may be varied to a much wider degree than would be the case than if merely engine speed were being used. The present invention is not directed to the specifics of how the microprocessor works, but rather to the manner in which the linking spider 80' is caused to move axially as a result of signals from microprocessor 200.

In this regard, a slightly different type of assembly knob 220 is utilized, but which does include a hub or shoulder 222 and threaded shaft 224 extending from the base thereof into connecting arrangement with the central threaded opening 58 in central hub 56' of inner plate 20'. Again, the threaded shaft 224 and hub 222 include an opening therethrough which communicates with the lubrication system of the engine. Toward this end, a passageway 230 in cam shaft B provides a pathway for lubrication from the engine lubrication system into the timing control device. Passageway 230 opens into a chamber 232 surrounding the valve head 236 of the solenoid operated valve 237. A spring 238 normally biases the valve 237 to the closed position as illustrated in FIG. 10, which corresponds to the advance position or the extended position of spider 80', corresponding in the other embodiment to the position illustrated in FIG. 7. The oil flows through the enlarged opening 234 in the threaded stub 224 around spring 238 and then through the smaller passageway 240 in threaded stub 224 to the small chamber 242. When the valve 237 is in the closed position, the oil then flows out through the small passageways 244 in the hub 222 into the chamber 140'. The oil pressure within chamber 140', so long as valve 237 is closed, then increases and urges the linking spider to its extended position as illustrated in FIG. 10.

When the microprocessor indicates that conditions are such that the cam shaft timing should be retarded, a signal is sent to solenoid 202 through connecting wires 204 creating a magnetic charge on the solenoid 202 which pulls valve 237 toward the left as indicated by the dotted line position in FIG. 10. As valve 237 moves toward the left, the oil from the small chamber 242 is then allowed to flow through the passageways 248, thereby bleeding off the oil pressure from chamber 140'. The drag on cam shaft B then causes the return of linking spider 80' to the retracted position (similar to that illustrated in FIGS. 3, 8, and 9*a*).

There is thus described an improved timing device for the cam shafts of multi-cylinder engines in which the timing of the cam shaft with relation to the crankshaft can be varied. While a detailed description of one embodiment and an alternate embodiment have been described hereinabove, it is apparent that various changes and modifications might be made to the embodiments illustrated and described without departing from the scope of the present invention which is set forth in the claims hereinbelow.

What is claimed is:

1. A hydraulically controlled, variable timing device for engine timing cam shafts of the type in which a rotatable cam shaft is arranged parallel to and driven by a rotatable crankshaft through a connecting chain or gear and in which said cam shaft operates the opening and closing of intake and exhaust valves, said variable timing device comprising:

(a) an inner plate secured to the end of said timing cam shaft and having at least one passageway therethrough in communication with the lubrication system of said engine;

(b) an outer plate surrounding the periphery of said inner plate in rotatably adjustable relation thereto and directly connected in synchronous driven arrangement to said crankshaft;

(c) a linking spider means mechanically connecting said inner plate and said outer plate through a toggle linkage and transmitting the driving force from said outer plate to said inner plate;

(d) said inner plate being rotatable to a cam shaft advance position responsive to the application of an axial bias on said linking spider means to move said spider means a first axially extended position during prescribed periods in the timing cycle;

(e) said inner plate being rotated to a cam shaft retard position responsive to frictional drag on the cam shaft combined with the removal of said axial bias on said linking spider which causes a return of said spider means to the retracted position.

2. The timing device according to claim 1 wherein the movement of said linking spider means to said extended position is accomplished responsive to increased oil pressure thereagainst which occurs at ignition and the removal of said axial bias on said spider means is accomplished by the reduction of said oil pressure.

3. The timing device according to claim 2 wherein the reduction of oil pressure is effected by means of a centrifugal valve which opens and bleeds off said oil pressure responsive to the attainment of a prescribed engine speed.

4. The timing device according to claim 3 wherein said linking spider means comprises a cylindrical side wall having an outer end and an inner end, said inner end surrounding said inner plate in axial sliding relation and a relatively large cover across said outer end; said cover, cylindrical side wall, and inner plate defining a chamber which receives oil through said passageway in the inner plate, the movement of said linking spider being occasioned by an increased volume of oil in said chamber which pushes against said cover to move said cylindrical wall relative to said inner plate, said centrifugal valve in communication with the interior of said chamber to bleed off oil when preset engine speeds are obtained.

5. The timing device according to claim 4 wherein said spider means further includes a plurality of peripherally spaced ears protruding radially outwardly from the cylindrical wall of said linking spider means, a trackway formed between said outer plate and said inner plate and receiving therein said spaced ears, said trackway further receiving a plurality of peripherally spaced fixed lugs extending inwardly from said outer plate and a plurality of peripherally spaced fixed lugs extending outwardly from said inner plate, each of said ears of the spider means connecting a corresponding inwardly extending lug of said outer plate and an outwardly extending lug of said inner plate through a plurality of links; said ear, lugs, and links being so arranged and connected that when said spider means is in said retracted position, said outer plate and inner plate are held in a first position arcuately fixed with respect to each other, then when said spider means is moved to the extended position responsive to the increase of oil pressure in said chamber, said outer and inner plates are moved arcuately with respect to each other to a second arcuately fixed position to advance the timing of said cam shaft.

6. The timing device according to claim 2 and further including a computer means for monitoring various engine functions and a solenoid connected thereto which receives electrical signals from said computer means, wherein said increase and decrease in oil pressure is effected by a control valve positioned in the supply line of oil to said timing device, said control valve being operated by said solenoid under the control of said electrical signal.

7. The timing device according to claim 6 wherein said linking spider means comprises a cylindrical side wall having an outer end and an inner end, said inner end surrounding said inner plate in axial sliding relation and a relatively large cover across said outer end; said cover, cylindrical side wall, and inner plate defining a chamber which receives oil through said passageway in the inner plate, the movement of said spider being occasioned by an increased volume of oil in said chamber which pushes against said cover to move said cylindrical wall axially relative to said inner plate, said control valve mounted in communication with the interior of said chamber to provide increased or reduced oil pressure therein responsive to said electrical signals to said solenoid.

8. The timing device according to claim 7 wherein said spider means further includes a plurality of peripherally spaced ears protruding radially outwardly from the cylindrical wall of said linking spider means, a trackway formed between said outer plate and said inner plate and receiving therein said spaced ears, said trackway further receiving a plurality of peripherally spaced, fixed lugs extending inwardly from said outer plate and the plurality of peripherally spaced fixed lugs extending outwardly from said inner plate, each of said ears of the spider means connecting a corresponding inwardly extending lug of said outer ring and outwardly extending lug of said inner ring through a plurality of links; said ears, lugs, and links being so arranged and connected that when said spider means is in said retracted position, said outer plate and inner plate are held in a first position arcuately fixed with respect to each other, then when said spider means is moved to the extended position responsive to the increase of oil pressure in said chamber, said outer and inner plates are moved arcuately with respect to each other to a second arcuately fixed position to advance the timing of said cam shaft.

* * * * *